US012703473B2

(12) United States Patent
Gai et al.

(10) Patent No.: US 12,703,473 B2
(45) Date of Patent: Aug. 11, 2026

(54) BOAT CONTROL DEVICE HAVING IDENTIFIABLE TRANSITIONS IN COMMAND LEVER TRAVEL

(71) Applicant: Ultraflex S.p.A., Casella (IT)

(72) Inventors: Marcella Gai, Busalla (IT); Marco Campagna, Genoa (IT)

( * ) Notice: Subject to any disclaimer, the term of this patent is extended or adjusted under 35 U.S.C. 154(b) by 119 days.

(21) Appl. No.: 18/408,496

(22) Filed: Jan. 9, 2024

(65) Prior Publication Data

US 2024/0228004 A1 Jul. 11, 2024

(30) Foreign Application Priority Data

Jan. 10, 2023 (IT) ..... 102023000000186

(51) Int. Cl.
*B63H 21/21* (2006.01)
*B63B 79/10* (2020.01)

(52) U.S. Cl.
CPC ..... *B63H 21/213* (2013.01); *B63B 79/10* (2020.01); *B63H 2021/216* (2013.01)

(58) Field of Classification Search
None
See application file for complete search history.

(56) References Cited

U.S. PATENT DOCUMENTS 8,353,393 B2 * 1/2013 St.Clair ..... B60T 7/085 188/161
12,296,935 B2 * 5/2025 Neathery ..... B63H 21/213
2006/0046585 A1 3/2006 Harada
2018/0354597 A1 12/2018 Fukuchi

FOREIGN PATENT DOCUMENTS

EP 2913237 9/2015

OTHER PUBLICATIONS

Italian Patent and Trademark Office, Search Report, Jul. 24, 2023—Relevant portions are in English.

* cited by examiner

*Primary Examiner* — Todd Melton
(74) *Attorney, Agent, or Firm* — Themis Law

(57) ABSTRACT

A boat control device includes a command lever mounted translatable on the command panel of the boat, in such a way that the command lever performs a travel of a predetermined amplitude, during which the command lever sets the propulsion engines of the boat according to at least two operating conditions, a clutch system being provided configured to identify the transition from one condition to another. The clutch system includes an electromagnetic brake acting on the command lever with a clamping force sufficient to brake the travel of the command lever, the clamping force varying based on the current generated by a power supply unit, the current being generated variably based on the position of the command lever.

9 Claims, 6 Drawing Sheets

BOAT CONTROL DEVICE HAVING IDENTIFIABLE TRANSITIONS IN COMMAND LEVER TRAVEL

FIELD OF THE INVENTION

The present invention relates to a control device for a boat comprising at least one command lever mounted translatable on the command panel of the boat, in such a way that the lever can perform a travel of a predetermined amplitude, during which travel the lever sets the propulsion engines of the boat according to at least two operating conditions. Clutch means are also provided which are adapted for identifying the transition from one operating condition to the other.

BACKGROUND OF THE INVENTION

Command levers known in the art enable setting the operation of the propulsion engines according to three operating conditions, forward gear, idle and reverse gear.

In the forward gear condition, the propellers of the propulsion engines are set to rotate clockwise, so as to create a forward gear thrust of the vessel.

In the reverse gear condition, the propellers of the propulsion engines are set to rotate counterclockwise, so as to create a backward thrust of the vessel, while in the idle condition the propellers have no rotation.

In the state of the art there are also left-handed and right-handed propellers, which, with the same direction of rotation, provide opposite thrusts. Many engine feet, for example, have two propellers that rotate on the same axis but in the opposite direction while providing thrust in the same direction.

Some levers known to the state of the art are configured so as to also set the magnitude of the speed of rotation of the propellers based on the translation of the same along its travel.

The travel of the lever has in fact two clutch points, respectively a first clutch point and a second clutch point, in such a way that the first clutch point identifies the transition between the forward gear condition and the idle condition, while the second clutch point identifies the transition from the idle condition to the reverse gear condition.

Starting from an end-of-travel point and approaching the first clutch point, or vice versa, the propulsion engines progressively increase the speed of rotation of the propellers, in the clockwise direction.

Similarly, starting from an end-of-travel point and approaching the second clutch point, or vice versa, the propulsion engines progressively increase the speed of rotation of the propellers, in the counterclockwise direction.

The clutch points of the levers known to the state of the art represent a particularly critical aspect, as they have a mechanical trigger system that, at the clutch points, triggers the lever in order to warn the user that he or she is switching from one operating condition to the other.

By moving the lever, the user, at the clutch points, will feel an increase in friction of the travel of the lever and will have to increase the shift force to overcome this friction.

This friction is obtained through the mechanical trigger system, which, however, consists of mechanical components that risk wearing out with use or even breaking suddenly.

In addition to the high risk of breakages, the mechanical trigger systems belonging to the levers known to the state of the art have complex constructions, precisely because of the large number of components that compose them.

It is evident that the construction complexity inevitably causes an increase in the production costs of the levers known to the state of the art.

There is therefore a need not met by the devices known to the state of the art to solve the disadvantages set out above.

SUMMARY OF THE INVENTION

The present invention achieves the above objects by providing a boat control device as described above, in which the clutch means are structured as an electromagnetic brake, configured for the generation of a clamping force acting on the lever, so as to brake its travel.

The clamping force varies based on the current generated by a power supply unit, which electric current is generated variably based on the position of the command lever.

According to the present configuration, therefore, all the mechanical clutch components present in the levers known to the state of the art are eliminated and replaced with an electromagnetic brake that allows a dynamic braking torque to be obtained, based on the voltage with which the brake is supplied.

By decreasing the number of components of the clutch means, the possibility of breakages or malfunctions of the components themselves is decreased.

Since in the command device subject-matter of the present invention the clutch means consist of an electromagnetic brake, interventions for replacing the components due to wear will not even be necessary, since the clamping action is exerted by a magnetic force, generated by the magnets of the electromagnetic brake towards the lever.

In addition, the use of an electromagnetic brake prevents the users from feeling the mechanical type clicks typical of the clutch means known to the state of the art, the movement of the lever will be particularly smooth, giving a pleasant feeling to the users, precisely thanks to the elimination of the mechanical clicks.

Starting from this general concept, i.e. from the use of an electromagnetic brake instead of the clutch means known in the state of the art, it is possible to provide several components aimed at improving the operation of the device subject-matter of the present invention.

According to a preferred embodiment, the lever is configured such that during the travel it sets the propulsion engines according to at least three operating conditions.

It is possible to provide that the lever belonging to the command device subject-matter of the present invention sets exclusively the forward gear direction, the reverse gear direction or the idle direction, that is, it sets the direction of rotation of the propellers of the propulsion engines.

In this case, the speed of rotation of the propellers can be commanded by a further device, such as for example a secondary lever, a button, or the like.

Alternatively, preferably, the command lever sets both the direction of rotation of the propellers, and the speed of rotation, exactly as described above, for the command levers known to the state of the art.

As will be apparent from the following disclosure, one of the most advantageous aspects of the present patent application is the possibility of customising the travel of the lever on the basis of the needs of the users.

In fact, the lever subject-matter of the present invention has no type of mechanical constraint regarding the clutch points, i.e. the points of transition from one operating condition to the other.

For this reason, the clutch points can be positioned in any position along the travel of the lever.

It follows that the lever subject-matter of the present invention allows subdividing the travel of the lever by assigning different amplitudes to the various operating conditions.

For example, a user may wish to have a greater amplitude for the forward gear condition by limiting the amplitude for the idle and reverse gear conditions.

This feature is particularly advantageous not only for the possibility of meeting the needs of the users by providing them with high customisation, but also because it allows the behaviour of the lever to be modified, that is, the transition of the operating conditions, also on the basis of the structural constraints of the vessel on which the lever is to be mounted, in order to facilitate the command thereof by the user.

As will be described later, the clutch points can be identified with an increase in the clamping force of the electromagnetic brake, but precisely because of the customizable appearance of the lever, it is possible to adjust the clamping action of the brake in any way, also by providing for a decrease in the clamping force at the clutch points.

Therefore, it is possible for the user to recognize that he or she is close to a clutch point choosing the mode that he or she prefers, increase or decrease, abruptly or more gently, of the clamping force.

The lever subject-matter of the present invention allows not only to customize the position of the clutch points along the travel of the lever, but also the number of the clutch points.

For example, according to a possible embodiment, it is possible to provide for the lever to have three clutch points and three operating conditions, in particular:

a reverse gear condition,
a first clutch point,
a first part of idle condition,
a second clutch point,
a second part of idle condition,
a third clutch point,
a forward gear condition.

Such a configuration is used to emulate the levers with mechanical clutch points known to the state of the art, but without their disadvantages.

Preferably, the first and second part of idle condition allow engaging, respectively, the reverse gear and the forward gear.

The amplitude of the travel of the lever in the forward gear condition and in the reverse gear condition allows the speed of rotation of the propellers to be adjusted.

In any case, it is possible to provide any configuration with any number of points along the travel of the lever that correspond to feedback points for the user, that is, that indicate to the user a particular moment in which, for example, a change of an operating condition or the transition from one operating condition to the other is approaching is envisaged.

In order to make the device subject-matter of the present invention adaptable to all operating needs and to modify its operation based on the needs of the users, the power supply unit comprises a control unit, configured for automatic adjustment of the power supply unit.

The presence of a control unit that directly sets the amount of electric current, that is, the voltage, applied to the electromagnetic brake and that, consequently, controls the clamping force, allows the operation of the command device subject-matter of the present invention to be modified in a simple way.

For example, it may be possible to provide continuous and constant friction along the entire travel of the lever, without providing specific clutch points.

In this case, specific marks could be provided on the panel or on a fixed part of the command device, that indicate the operating condition of the engines based on the positioning of the lever.

Further, the control unit may be set so as to generate haptic feedback to a user based on the positioning of the lever, e.g. feedback of the vibrational type, as well as torque or thunderstorm feedback.

For example, upon reaching an end-of-travel position of the lever, sudden increases and decreases in the clamping force could be envisaged, so as to generate a kind of vibration, which alerts the user when he or she is approaching the end of the shift of the lever.

The possibility of changing the clutch points, i.e. the points along the travel of the lever where the change of an operating condition is envisaged, gives the users the possibility of customising, in various ways, the operation of the device subject-matter of the present invention.

For example, the clutch points could be set so that the "forward gear" condition has a greater amplitude than the "reverse gear" and "idle" condition.

Furthermore, the presence of the control unit allows the device subject-matter of the present invention to interface with one or more sensors, so as to be able to adjust the intensity of electrical energy also on the basis of the information deriving from the sensors.

According to a possible embodiment, there is a position sensor communicating with the control unit and aimed at identifying the position of the lever with respect to its travel.

Also in this case, the position sensor allows to easily obtain variable clutch points by adjusting the trigger angles, i.e. the amplitude of the travel before changing the operating condition.

Furthermore, it is possible to customize the operation of the device subject-matter of the present invention also by inserting further points where there is an increase in torque from the electromagnetic brake.

For example, it could be assumed to increase the magnetic torque both when the lever is at the clutch points and when the lever is at a certain amplitude of its travel, such as for example at mid-travel of each operating condition.

Preferably the torque at the clutch points should be different, higher or lower, than the other torque.

According to a further embodiment, the device subject-matter of the present invention provides an electric engine acting on the lever, configured to shift the lever along its travel.

The electric engine is commanded by the control unit, which can be programmed to set the activation of said electric engine.

For example, it could be provided that, in case a user does not exert any force on the lever, the lever is shifted by the electric engine into an idle condition, so as to obtain an automatic deceleration, in a manner quite similar to what happens to the pedal of the accelerator in the cars.

The presence of the engine also allows performing a remote control of the lever, as a user, through specific applications, could command at a distance the movement of the lever, as well as could modify the action of the clamping force of the electromagnetic brake.

According to a further embodiment variant, there is a sensor system communicating with the control unit and aimed at detecting one or more sailing parameters of the vessel.

The control unit will therefore be able to adjust the intensity of the electric current generated based on the sailing conditions of the vessel, speed, obstacles in the vicinity of the vessel, turn, sea conditions or the like.

The command device subject-matter of the present invention therefore allows to perform a sort of "cruise control", in which the clutch acting on the command lever is based on the sailing conditions of the vessel.

In the event that the sailing conditions required it, the control unit could realize a speed limiter, that is, enable the travel of the lever only for a certain amplitude, increasing the clamping force to avoid reaching too high speeds.

The presence of a sensor system has particularly advantageous aspects in combination with the presence of the electric engine acting on the shift of the lever, since the control unit could operate the electric engine, which in turn moves the lever to obtain an automatic deceleration, for example in case an obstacle is sighted on the trajectory of the vessel.

Furthermore, according to the latter configuration, the control unit can put the lever into a more suitable configuration, through the electric engine, adjusting its speed and operating condition, based on the sailing conditions.

According to an improvement, the control unit comprises a communication unit configured to communicate with a remote unit.

Therefore, a remote control of the lever is performed, a user can modify the position of the lever from a remote device, such as for example a tablet, a smartphone or the like.

It is evident that the control unit can envisage increasing the torque at the clutch points when a user commands the lever, but in the case of automatic command by the electric engine, the torque could be constant throughout the entire travel of the lever.

Based on what has been described, it is evident that the operation of the device subject-matter of the present invention is adaptable to the different operating needs, both of the users and sailing conditions.

According to one embodiment, the control unit is configured in such a way as to set two different clutch points along the travel of the lever, which clutch points identify the transition from one operating condition to the other.

Further, the control unit is configured to increase the clamping force when the lever approaches the clutch points and to decrease the clamping force when the lever moves away from the clutch points.

According to an improvement, of the configuration just described, the control unit is configured to progressively increase and/or decrease the clamping force of the lever towards and/or away from the clutch points.

BRIEF DESCRIPTION OF THE DRAWINGS

These and other features and advantages of the present invention will become clearer from the following disclosure of some embodiment examples illustrated in the accompanying drawings in which.

It should be noted that the figures enclosed to this patent application illustrate only some possible embodiments of a boat control device according to the present invention for a better understanding of the disclosed advantages and characteristics.

Those embodiments are therefore to be understood as purely illustrative and not limiting the inventive concept of the present invention, that is, providing a boat control device with a command lever, in which the clutch of the command lever is realized using an electromagnetic brake applied to the lever, so as to adjust its travel.

DETAILED DESCRIPTION OF EMBODIMENTS OF THE INVENTION

Figure 1:
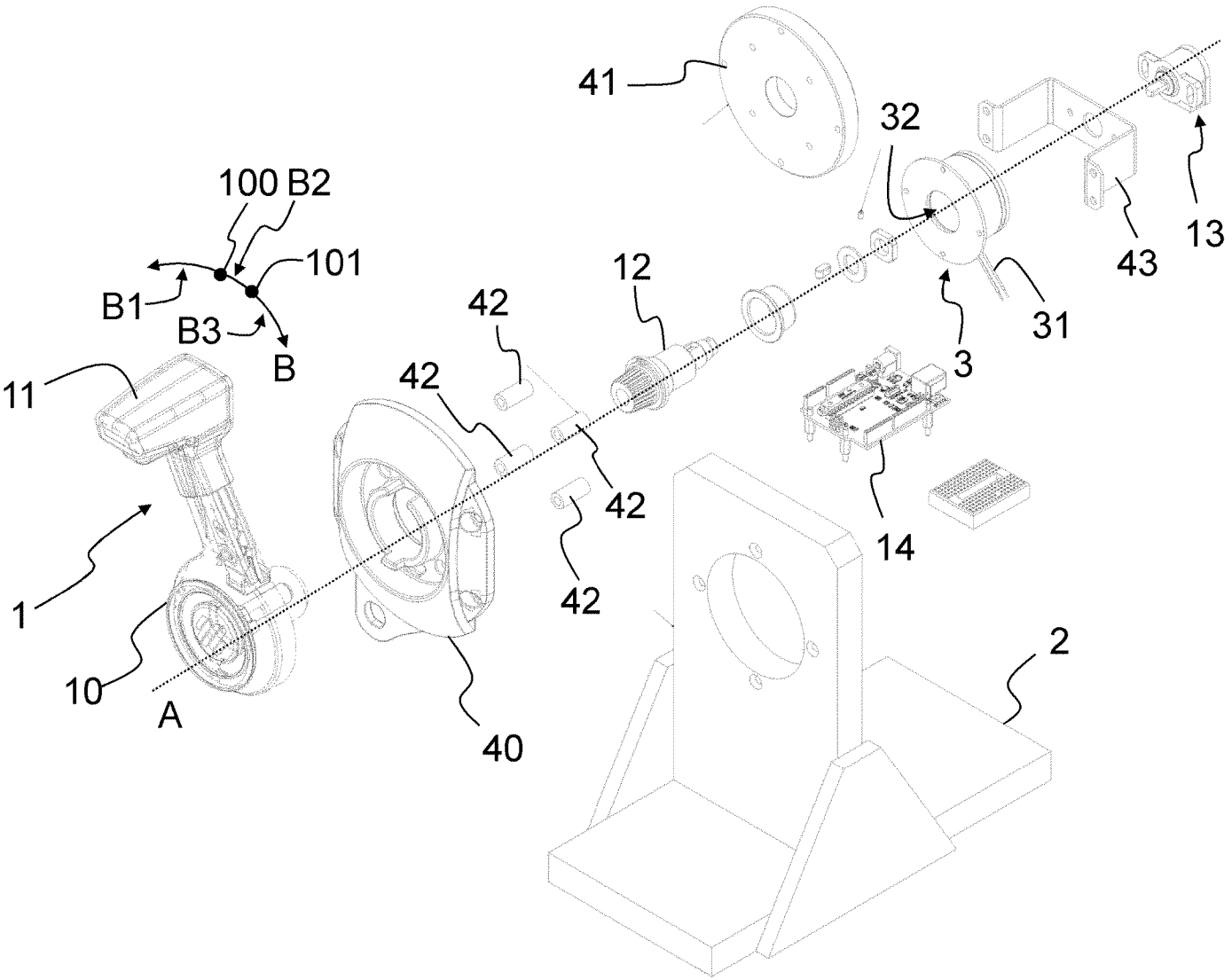
FIG. 1 illustrates an exploded view of a boat control device according to the present invention.
Figure 2A:
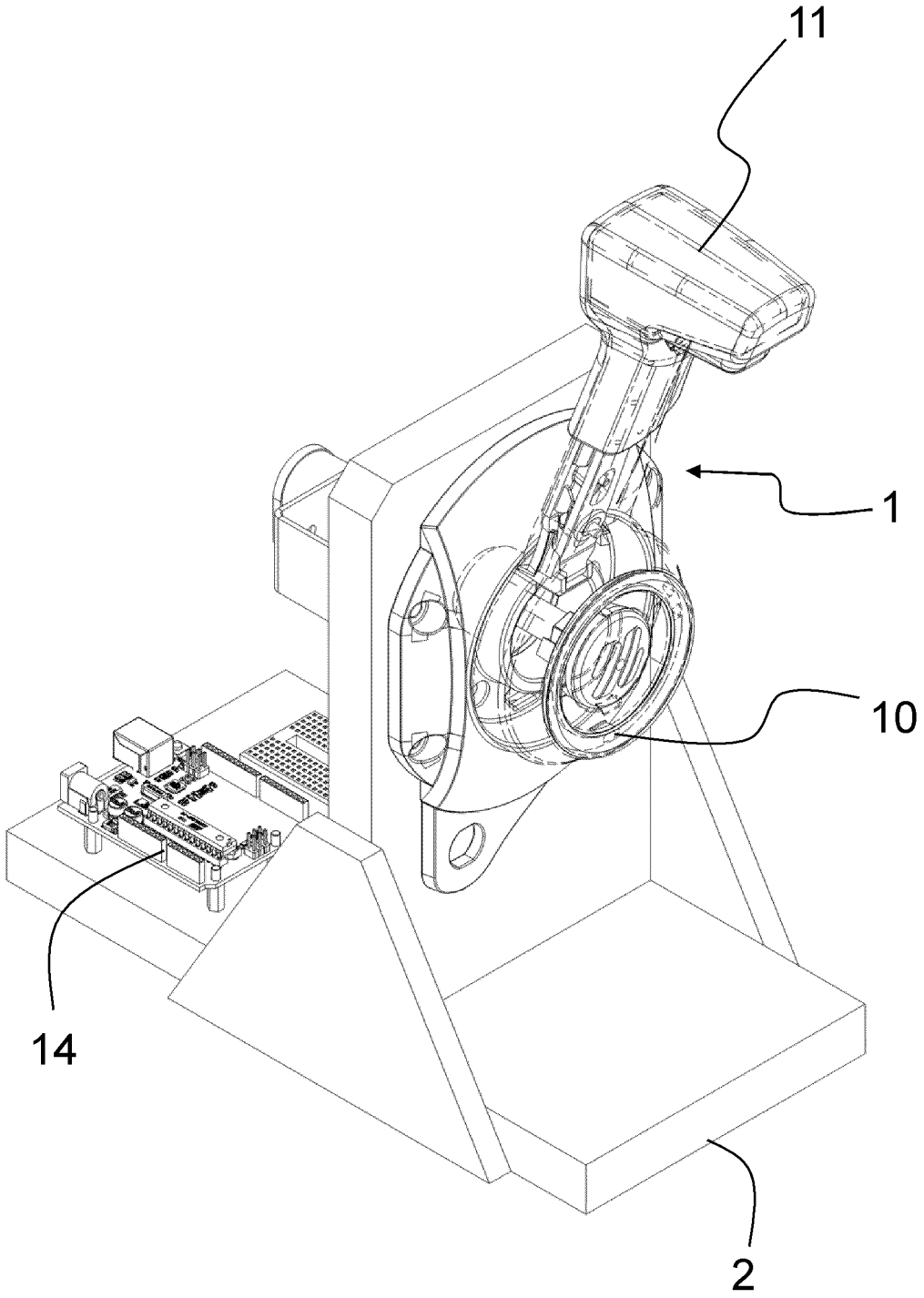
FIGS. 2*a* to 2*e* illustrate different views of an assembled boat control device according to the present invention.
Figure 2B:
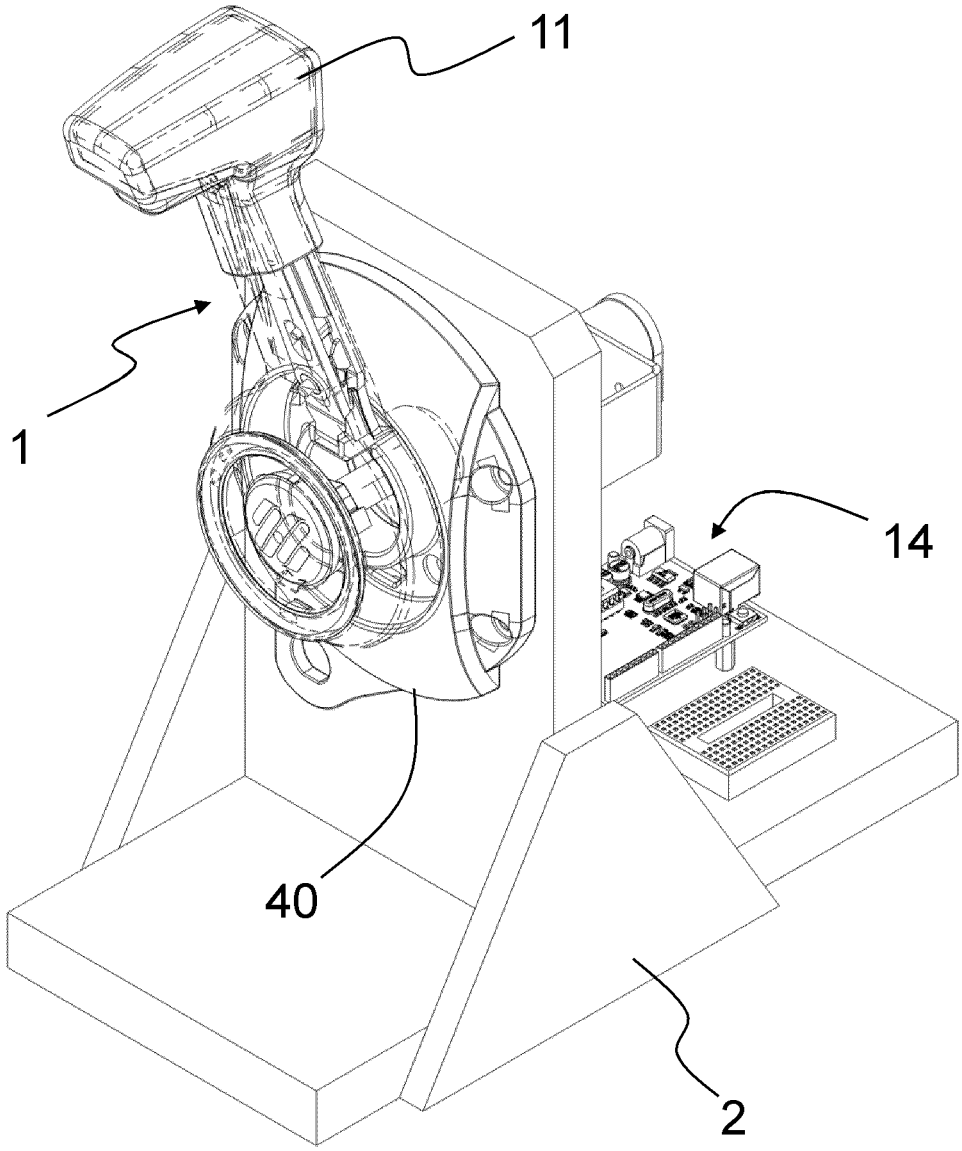
Figure 2C:
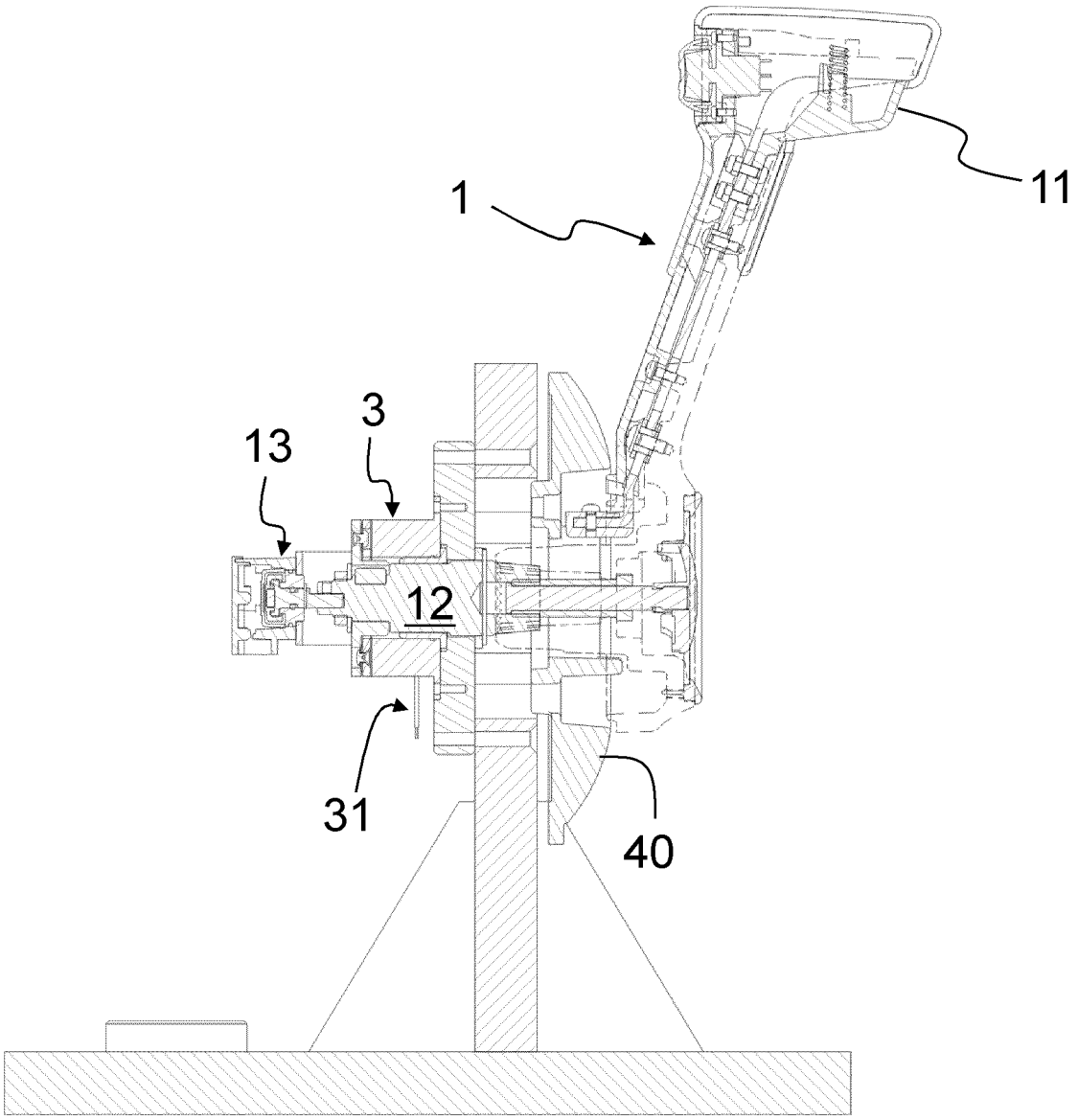
Figure 2D:
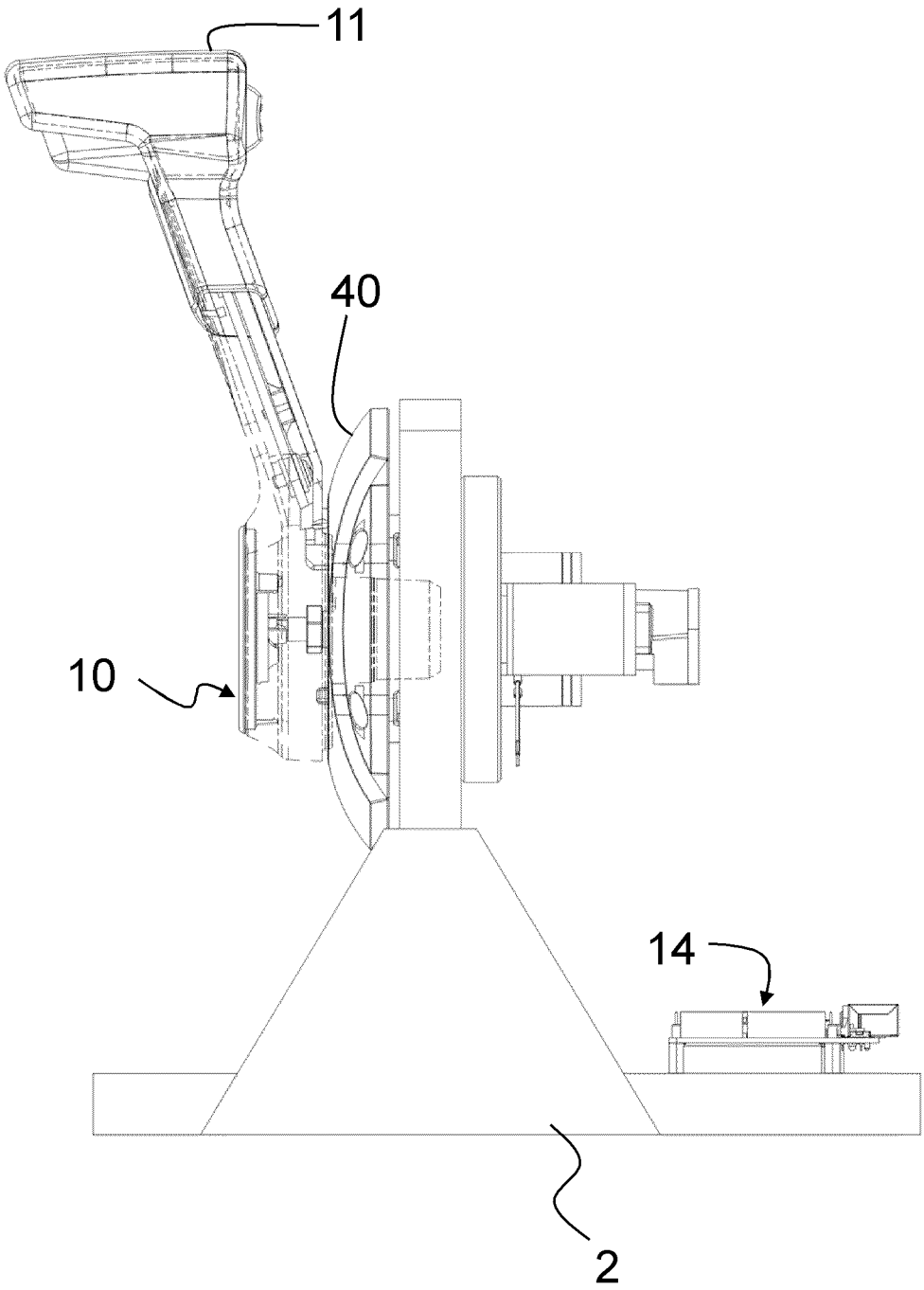
Figure 2E:
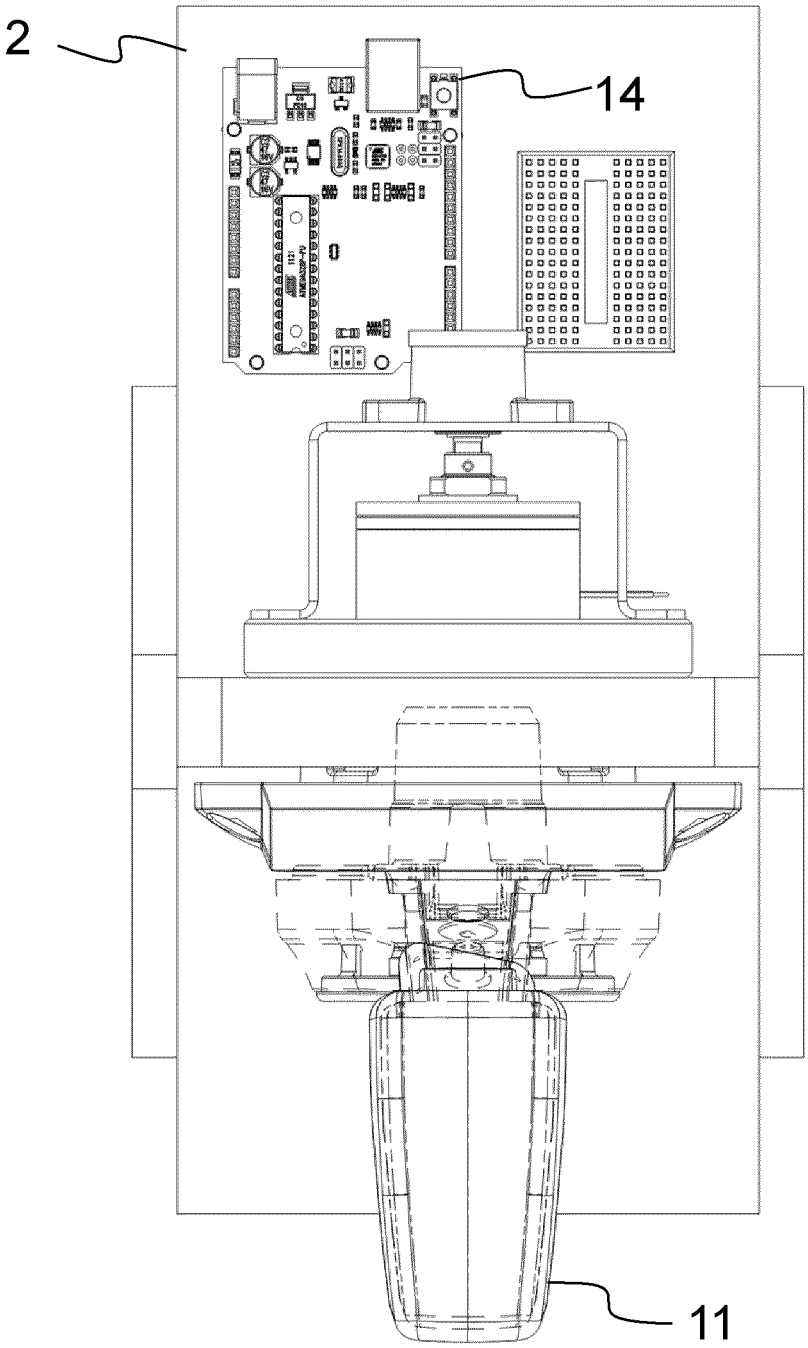

With particular reference to FIG. 1, a boat control device according to the present invention comprises a lever 1, mounted translatable, in particular mounted oscillating with respect to the panel of the vessel.

The lever 1 can therefore rotate around the axis A, to perform a travel of a certain length B, so as to have a relative movement with respect to the panel of the vessel, in particular with respect to the support frame 2, integral with the panel of the vessel (not illustrated in the figure).

The lever 1 has a handle 11 and a body 10, integral with the axis 12 of the lever 1: a user can act on the handle 11 to shift the lever along the travel B: the shift of the lever 1 allows the propulsion engines (not illustrated in the figure) to be set according to three different operating functions, as will be described below.

The shift of the lever 1 along the travel B causes the rotation of the shaft 12 of the lever 1 around the axis A.

This rotation is detected by the position sensor 13, configured to detect the position of the axis and, consequently, the position of the lever 1 along the travel B.

As anticipated, based on the position of the lever 1 along the travel B, the propulsion engines can be set according to different operating modes.

According to the example of FIG. 1, the travel B of the lever 1 has three different sections, corresponding to three different operating modes, in particular:

- the first section B1 corresponds to the forward gear condition of the vessel, in which the propellers of the propulsion engines rotate clockwise,
- the second section B2 corresponds to the idle condition, in which no rotation of the propellers is envisaged,
- the third section B3 corresponds to the reverse gear condition of the vessel, in which the propellers of the propulsion engines rotate counterclockwise.

Between section B1 and section B2 and between section B2 and section B3 there are clutch points, respectively 100 and 101, at which the change of setting of the operating condition of the engines takes place, i.e. the points 100 and 101 are clutch points.

As anticipated, the travel B of the lever 1, in addition to setting the operating conditions of the outboard engines, also allows the speed of rotation of the propellers to be adjusted, so that the more the lever 1 travels along the sections B1 and B3, the greater the speed of rotation of the propellers will be.

The direction and the speed of rotation of the propellers are therefore set on the basis of the position of the lever 1 along the travel B, a position that is detected by the position sensor 13, which communicates with the control unit 14, which supervises the operation of the system.

In particular, the position sensor 13 indicates to the control unit 14 whether the lever 1 is located along the section B1, B2 or B3 and the control unit 14 generates corresponding command signals to be sent to the outboard engines.

Based on the variant illustrated in the figures, the information deriving from the position sensor 13 is used by the control unit 14 to energize the electromagnetic brake 3 connected to the control unit 14 through corresponding cables 31.

The control unit 14 can in fact have a power supply unit aimed at generating an electric current that applies a corresponding voltage to the electromagnetic brake 3.

The electromagnetic brake 3 has a through hole 32, configured to accommodate, at least partially, the shaft 12.

The electromagnetic brake 3, based on the voltage applied by the control unit 14, generates a magnetic force that causes a clamping force on the shaft 12, the effect of which is to brake the rotation of the shaft 12 and, consequently, the travel of the lever 1.

The control unit 14 can be set so as to adjust the operation of the command device subject-matter of the present invention.

For example, it is possible to provide that, when the lever 1 is at the points 100 and 101, the voltage applied to the electromagnetic brake 3 is such as to increase the clamping force acting on the shaft 12.

It follows that the user, when moving the lever 1 at the points 100 and 101, will have the feeling of an increase in friction, which will signal him or her the transition from one condition to the other.

It is possible to set the control unit 14 so as to adjust the clamping force: in addition to increasing the clamping force at the points 100 and 101, it is possible to provide for progressively increasing the clamping force as the lever 1 approaches the points 100 and 101 and to progressively decrease it when the lever 1 moves away from the points 100 and 101.

From what has just been described, it is evident that the points 100 and 101 are virtual points, which can be shifted based on the setting of the control unit 14, since there are no mechanical constraints of these points.

The travel B of the lever 1, in fact, corresponds to a certain angle of rotation of the shaft 12 and the control unit 14, the measure of the angle of rotation of the shaft 12 being known, will be able to set the end-of-travel positions as well as the length of the sections B1, B2 and B3.

It could for example be useful, as illustrated in FIG. 1, to provide for a section B1 longer than section B3, in turn longer than section B2, to facilitate the use of the lever 1 during sailing, so that the user can have a greater excursion for adjusting the acceleration in the forward gear condition, compared to the idle condition, section B2, or to the reverse gear condition, section B3.

As described above, other solutions may be provided, based on the operating needs of the user, such as for example to provide a constant voltage to the electromagnetic brake 3 in order to generate a constant clamping force along the entire travel B of the lever 1, as well as it is possible to provide for an increase in the clamping force under the condition of the end-of-travel positions of the lever 1.

The various components of the device subject-matter of the present invention described above, can be assembled according to the ways known to the state of the art, for example by using flanges 40, 41, spacers 42 and support elements, such as for example the support 43 of the position sensor 13.

The different components are assembled through a coupling along the direction of the axis A, which components are then fixed to the support frame 2.

The support frame 2, the support device 43, the flanges 40, 41 and the spacers 42, as well as the control unit, are integral with each other and with the panel of the vessel, while the lever 1, the shaft 12 and the position sensor 13 rotate with respect to the panel of the vessel.

Once the different components have been assembled, the command device subject-matter of the present invention appears like in the views from FIG. 2*a* to FIG. 2*e*.

The support frame 2 can be mounted at the panel of the vessel, laterally, superiorly, anteriorly or posteriorly to said panel.

While the invention is susceptible to various modifications and alternative constructions, some preferred embodiments have been shown in the drawings and described in detail.

It should be understood, however, that there is no intention to limit the invention to the specific illustrated embodiment but, on the contrary, the aim is to cover all the modifications, alternative constructions and equivalents falling within the scope of the invention as defined in the claims.

The use of "for example", "etc.", "or" indicates non-exclusive alternatives without limitation, unless otherwise indicated.

The use of "includes" means "includes but is not limited to", unless otherwise stated.

The invention claimed is:

1. A control device for a boat comprising:

a command lever translatable on a command panel of the boat, in such a way that the command lever performs a travel of a predetermined amplitude, during which the command lever sets propulsion engines of the boat according to at least two operating conditions; and a clutch system adapted to identify a transition from one of the at least two operating conditions to another one of the at least two operating conditions, wherein the clutch system includes an electromagnetic brake acting on the command lever with a clamping force sufficient to brake the travel of the command lever, the clamping force varying based on a current generated by a power supply unit, the current being generated variably based on a position of the command lever, wherein the power supply unit comprises a control unit configured to automatically adjust the power supply unit, wherein the control unit is configured to set one or more different clutch points along the travel of the command lever, the clutch points identifying a transition from one of the at least two operating conditions to another one of the at least two operating conditions, the control unit being configured to increase the clamping force when the command lever approaches the clutch points and to decrease the clamping force when the command lever moves away from the clutch points, and wherein the one or more different clutch points are virtual points having positions that can be shifted based on settings of the control unit.

2. The control device according to claim 1, wherein the command lever is configured, during the travel, to set the propulsion engines according to at least three operating conditions.

3. The control device according to claim 1, further comprising a position sensor configured to identify a position of the command lever with respect to the travel of the command lever, the position sensor communicating with the control unit.

4. The control device according to claim 1, further comprising an electric motor acting on the command lever and configured to shift the command lever along the travel thereof, the electric motor being commanded by the control unit.

5. The control device according to claim 4, wherein the control unit is configured to cause the electric motor to shift the command lever to one or more predetermined positions along the travel of the command lever without external forces acting on the command lever.

6. The control device according to claim 1, further comprising a sensor system configured to detect one or more sailing parameters of the boat, the sensor system communicating with the control unit.

7. The control device according to claim 1, wherein the control unit is configured to progressively increase or decrease the clamping force of the lever towards or away from the clutch points.

8. The control device according to claim 1, wherein the control unit comprises a communication unit configured to communicate with a remote unit.

9. The control device according to claim 1, wherein the control unit is configured to progressively increase the clamping force when the command lever approaches the clutch points and to progressively decrease the clamping force when the command lever moves away from the clutch points.

* * * * *